United States Patent [19]

Goldhammer

[11] 4,391,412

[45] Jul. 5, 1983

[54] APPARATUS FOR LIMITING FILLING HEIGHT OF CONTAINERS

[76] Inventor: Albert Goldhammer, Zum Hecht 46, 7770 Uberlingen, Fed. Rep. of Germany

[21] Appl. No.: 195,767

[22] Filed: Oct. 10, 1980

[30] Foreign Application Priority Data

Oct. 18, 1979 [DE] Fed. Rep. of Germany ..... 2942241

[51] Int. Cl.[3] ..... B02C 23/00

[52] U.S. Cl. ..... 241/36; 222/56; 221/10

[58] Field of Search ..... 241/36; 222/56; 221/10, 221/207; 141/83, 377, 372, 272, 271, 198

[56] References Cited

U.S. PATENT DOCUMENTS

| | | | |
|---|---|---|---|
| 410,138 | 8/1889 | Cooley | 222/56 |
| 1,333,094 | 3/1920 | Reed | 241/36 X |
| 2,030,448 | 2/1936 | Hardgrove | 241/36 X |
| 2,827,082 | 3/1958 | Baum | 141/272 X |
| 2,868,109 | 1/1959 | Davis | 241/36 X |
| 2,899,140 | 8/1959 | Hellyer | 241/36 X |
| 2,900,140 | 8/1959 | Schuhmann et al. | 241/36 |
| 3,581,517 | 6/1971 | Pizzi | 222/56 X |

FOREIGN PATENT DOCUMENTS

| | | | |
|---|---|---|---|
| 225504 | 4/1958 | Australia | 241/36 |

*Primary Examiner*—Willie G. Abercrombie
*Attorney, Agent, or Firm*—Sherman Levy

[57] ABSTRACT

Apparatus for limiting the filling height of containers for receiving shredded or minced paper film or the like from cutting or shredding machines, characterized by a switch for stopping the machine when the container is filled to a predetermined height, the container being pivotally mounted with one side of its bottom edge on a housing and the opposite edge on a spring, and a switch controlling the operation of the cutting or shredding machine mounted in the path of the spring.

7 Claims, 1 Drawing Figure

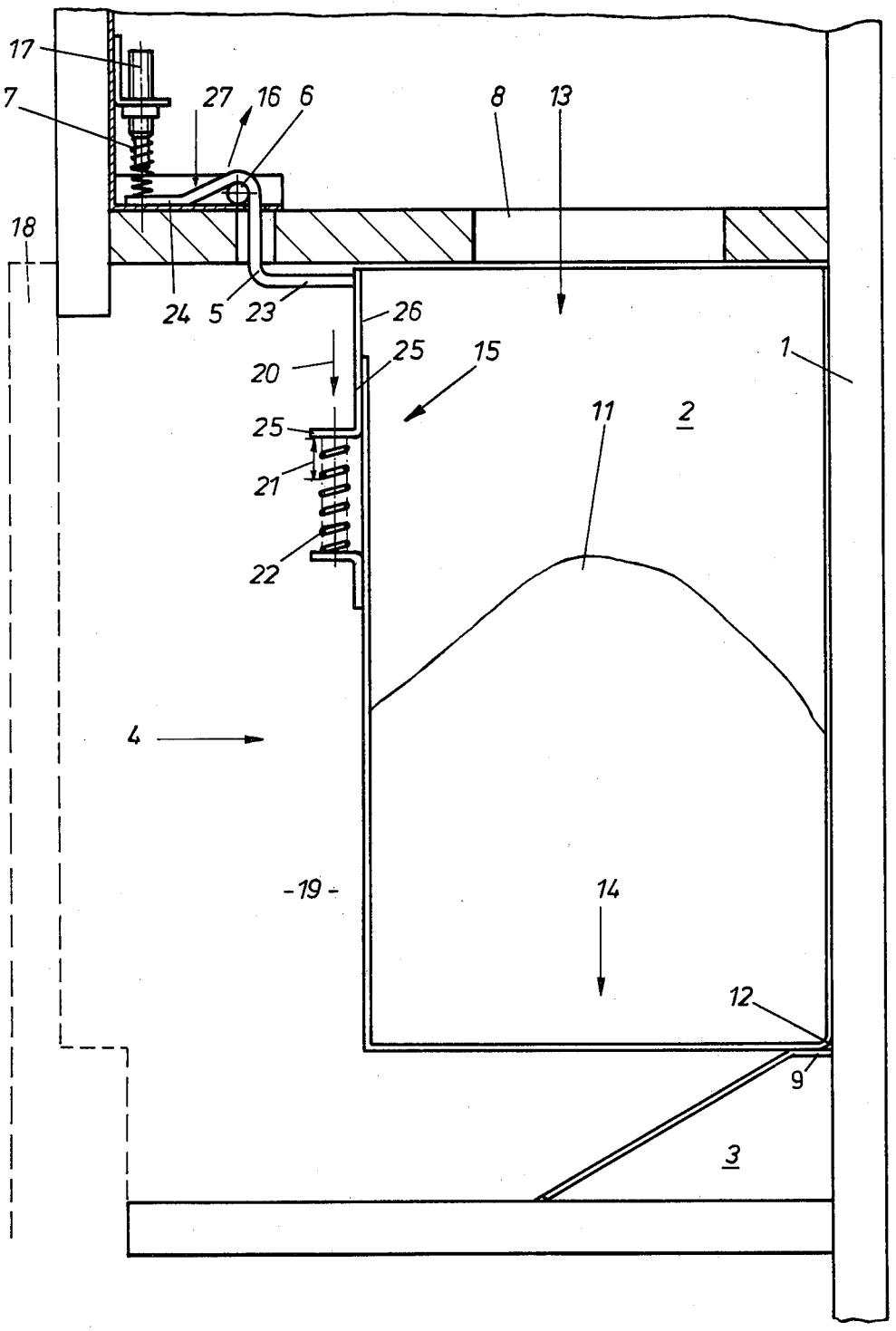
17
7
27
16
6
8
13
18
24
5
23
26
25
15
1
20
11
2
25
21
22
4
-19-
14
12
9
3

APPARATUS FOR LIMITING FILLING HEIGHT OF CONTAINERS

The subject matter of the invention is a device for limiting the filling height in a container to be loaded for a cutting or shredding machine in particular for the destroying of documents or microfilm.

Hitherto with containers for cutting or shredding machines in particular for the destroying of documents or microfilm the shredding or cutting mechanism was left running so long as the operator could observe through the filling opening of the apparatus the filling cone in the container. This had the drawback that the container upon inattention of the operator was completely filled up so that the material was even filled in beyond the filling opening, thereby arriving again into the cutting mechanism and was cut up a second time. Hence there resulted an extraordinarily large amount of dust exposure and a development of heat on the drive of the cutting mechanism.

The invention has as its the object the further developing of a device of the abovementioned type such that an automatic switching off of the drive of the cutting or shredding mechanism is effected when the container is filled up to a certain filling height.

As an object subordinated to this object the invention furthermore aims at designing the automatic switching off dust proof, simple and cheap.

For the solution of the problem posed the invention is characterised in that the limitation of the filling height is effected by the switching off of the shredding mechanism in that the container is mounted pivotable like a one-armed lever with its bottom edge in a housing and that the edge of the container diagonally opposite the bottom edge is mounted spring-loaded on the housing whereby a switch operating the shredding mechanism is disposed in the path of the spring.

An essential feature of the present invention provides for a container that is mounted like a one armed lever pivotable in the housing with its container edge opposite the bottom edge received in the pivot bearing and holder and thereupon is held by a spring loaded catch. The more material is now filled in above the filling opening in the container, the heavier the container becomes and it tilts against the force of the spring loaded catch about its pivotably mounted bottom edge as a pivot bearing. As soon as the displacement of the spring loaded catch, depending on the increasing weight of the material, exceeds a certain path, a switch is actuated with the catch, it switches off the drive of the shredding mechanism and as the case may be, switches on a control lamp which indicates to the user that the apparatus has switched off because of exceeding the predetermined filling height and that the container is now to be removed from the apparatus and it is thereby emptied.

It is hereby especially preferable that the pivotable bearing of the bottom edge of the container on the housing is formed by an inclined plane ascending from the bottom of the housing on the step of which the bottom edge contacts. This advantage is achieved because the container can in a simple manner be pushed into the filling shaft of the housing so that the bottom edge lying behind in the push in direction comes onto the inclined plane and slides along the inclined plane. At the end of the inclined plane a stop is provided on which then the bottom edge of the container rests. With the pushing in of the container into the filling shaft of the housing, the container is therefore raised simultaneously and the rear bottom edge is mounted pivotably on the housing.

With the arrangement of an bottom region of the housing a substantial advantage is achieved. The pushing in of the container cannot be adversely affected by dirt and material depositing on the bottom. If the container is removed from the housing after filling then the rear bottom edge of the container slides down on the inclined plane and thus automatically cleans the bottom region of the housing so that this is kept substantially free of dirt.

Furthermore it is essential that there not to be any switch in the bottom region of the container because due to dust and material unavoidably located in the filling shaft such a switch disposed in the bottom region of the housing would be extremely liable to become dirty. It is therefore preferable for the switch to be disposed above and outside the housing shaft. For the operation of the switch a spring loaded catch formed as a two armed lever is provided which having one end constructed as a sensing lever contacts the container edge lying at the front at the top in the direction of insertion and at its other end constructed as an operating lever, connects to the electric switch.

The two armed lever is thus fixed to the upperside of the housing so that the sensing lever is disposed inside the filling shaft and the operating lever for operating the switch is disposed outside and above the filling shaft. In this way the switch is kept free from dust and other impurities of the filling shaft.

It has been explained above how the container is pushed into the filling shaft of the housing and is held there.

In order to be able to remove the container from the filling shaft of the housing after switching off the cutting or shredding mechanism the spring must be raised from contacting the sensing lever of the spring loaded catch on the side of the container above and to the front in the push in direction. There is provided for this purpose unlocking device for the removal of the container from the filling shaft and for the subsequent pushing in of the empty container is provided.

According to the invention the sensing lever of the spring loaded catch does not engage directly on the wall of the container but is located on a slide which is movably mounted, spring loaded on the front side of the container. To the slide there is connected in one or two a handle with which the container can be removed from the filling shaft of the housing. For unlocking the handle with the slide connecting thereon is taken hold of by hand and drawn downwards against the force of the spring. For this purpose the sensing lever of the spring loaded catch comes out of engagement with the slide so that the container by downward tilting and subsequent drawing out can be removed from the filling shaft of the housing.

The subject matter of the present invention follows not only from the subject matter of the individual patent claims but also from the combination of the individual patent claims with one another.

The invention will be described with reference to the accompanying drawings.

In a housing 1 there is disposed a bore 19 which is closed at the front by a door 18, not shown in detail. In the illustration a container 2 is shown in its locked position to the housing 1. The material cut into small pieces by a cutting and shredding tool is filled from above into the container 2 in the direction of the arrow 13 through a filling opening 8.

A cone 11 of filling material is then built up, the shape of which depends on the type of material to be reduced to small pieces.

The filling cone 11 exercises a force in the direction of the arrow 14 on the bottom of the container 2 so that also the left hand edge of the container 2 causes a twisting moment directed in the direction of the arrow 15 because the right hand rear bottom edge 12 of the container 2 is pivotably mounted on the stop 9 of an inclined plane 3.

With increasing height of the filling cone 11 a greater twisting moment in the direction of the arrow 15 is exercised on the front upper wall of the container 2.

A spring loaded catch 5 contacts the upper front side of the container 2 which consists in a one piece sensing lever 23 and operating lever 24. The catch 5 is rotatably mounted on a pivot 6 and tensioned by a spring 7. The force of the spring 7 can be adjusted by the knurled nut 17. With increasing filling weight because the sensing lever 23 contacts on the front side of the container the operating lever 24 pivots in the direction of the arrow 16 .

On the operating lever is also located the switch notch of a switch 27, not shown in detail. From a certain pivot angle in the direction of the arrow 16 the switch is operated and the pulverizing and shredding mechanism is stopped.

At the same time a control lamp, not shown, lights up which indicates to the user that the switching off of the pulverising mechanism has been effected because of exceeding the filling height and the user must now remove the container 2 from the filling bore 19 in an opposite direction to the arrow 4 and empty it.

For removing the container 2 in the opposite direction to the arrow 4 the force locking contact between the sensing lever 23 and the catch 5 and the container 2 must be released. To do this a separate locking and unlocking device is provided. It consists of a spring loaded slide 25 movably mounted on the housing wall which slide can be pressed by means of a spring 22 into the position shown. For removing the container from the housing shaft 19 the slide 25 with the aid of a handle, not shown, is pressed downwards against the force of the spring 22 in the direction of the arrow 20. The movement of the slide 25 in the direction of the arrow 20 must extend a distance 21 so that the upper side of the slide 25 comes out of engagement with the sensing lever 23 and the sensing lever 23 engages in an opening 26 in the container 2. Now the force locking contact between the container 2 and the sensing lever 23 is removed so that the container 2 can be pivoted downwards in the direction of the arrow 15 and drawn out from the housing bore 19 in the opposite direction to the arrow 4.

It is important for the catch to be formed as a two armed lever so that the sensing lever 23 is located in the housing bore 19 and the operating lever 24 is located above and outside the housing bore 19. The switch 27 is thus protected from dirt and non-permissible manipulations.

I claim:

1. An apparatus for limiting the filling height of a container for a cutting or shredding machine for the destruction of documents and microfilms, a container pivotally mounted in a housing and having a base, a rear end and a front end, the housing supporting the rear end of the container on a horizontal portion of an inclined support extending upwards from the base of the housing, an upper end of the front end of the container being supported by a spring catch actuating switch means to stop a cutting or shredding machine when a predetermined height is sensed and reached.

2. Apparatus according to claim 1, wherein the front side of the container is disposed diagonally to a bottom edge (12), a sensing lever (23) of a spring loaded catch (5) includes mounting of a two armed lever, the other end of which lever provides an operating lever (24) controlled by a spring (7).

3. Apparatus according to claim 2, wherein the tension of the spring (7) is adjustable.

4. Apparatus according to any one of the claims 1 to 3, wherein the container is held in position by means including a spring loaded catch engaging a slide (25) operated by a spring (22), and means providing release of the container by a downward manual movement of the slide.

5. Apparatus according to claim 4, wherein the slide (25) is responsively and electromechanically operated.

6. Apparatus according to any one of the claims 1 to 5 wherein the switch means (27) is disposed at a top and outside of the housing bore.

7. An apparatus for limiting the filling height of a container for a machine for cutting or shredding and for the destruction of documents, microfilms and the like, comprising a housing having a base, an inclined support extending upwardly from said base, and said inclined support having a horizontal portion and including a container, said container being pivotally mounted in said housing and said container having its rear end supported on the horizontal portion of said support, a spring catch supporting an upper front end of the container, and said spring catch adapted to activate a switch for stopping the cutting or shredding machine when a predetermined height of material in the container is sensed and reached, a sensing lever disposed adjacent the upper front end of the container and operatively engaging said spring catch, said lever embodying a two arm lever, a spring member engaging a portion of said last named lever, said spring member being adjustable, said catch including a spring loaded slide whereby release of the container is accomplished by downward movement of said slide.

* * * * *